US006491787B2

(12) United States Patent
Peltonen et al.

(10) Patent No.: US 6,491,787 B2
(45) **Date of Patent: *Dec. 10, 2002**

(54) METHOD FOR HEATING PULPS

(75) Inventors: Kari Peltonen, Kotka (FI); Reijo Vesala, Kotka (FI); Vesa Vikman, Kotka (FI)

(73) Assignee: Andritz Oy, Helsinki (FI)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/509,474

(22) PCT Filed: Oct. 14, 1997

(86) PCT No.: PCT/FI97/00623

§ 371 (c)(1),
(2), (4) Date: Mar. 28, 2000

(87) PCT Pub. No.: WO99/19560

PCT Pub. Date: Apr. 22, 1999

(65) Prior Publication Data

US 2002/0040771 A1 Apr. 11, 2002

(51) Int. Cl.[7] ..... D21C 1/02; D21C 7/10

(52) U.S. Cl. ..... 162/52; 162/57; 162/68; 366/263

(58) Field of Search ..... 162/52, 47, 57, 162/68, 246, 243; 366/262, 263

(56) References Cited

U.S. PATENT DOCUMENTS 5,536,368 A * 7/1996 Makela et al. ..... 162/52
5,690,786 A * 11/1997 Cirucci et al. ..... 162/68

FOREIGN PATENT DOCUMENTS

| | | |
|---|---|---|
| DE | 24 41 579 | 3/1975 |
| SE | 9604324-5 | 5/1998 |
| WO | WO 93/09391 | 5/1993 |
| WO | WO 95/21016 | 8/1995 |
| WO | WO 96/30586 | 10/1996 |
| WO | WO 97/00998 | 1/1997 |

OTHER PUBLICATIONS

Kassberg, "Blekning komplement Yrkesbok Y–208H" (translation: "Bleaching complement, Craftman's manual Y–208H", Skogsindustrins utbildning I Markaryd (translation: Forest Industry Education in Markaryd, 1995, pp. 52 and 53 and English translation thereof.

Lundgren, MC–Technology—A Kamyr Innovation, Kamyr Technical Symposium, Jakarta, Indonesia, Nov. 23–24, 1990, 33 pages.

* cited by examiner

*Primary Examiner*—Steve Alvo
(74) *Attorney, Agent, or Firm*—Nixon & Vanderhye P.C.

(57) ABSTRACT

A method and apparatus for heating cellulose pulp with steam are provided. Low-pressure (e.g. 3–5 bar (abs.)) steam is supplied into the pulp flowing as a plug flow in such a way that in the flow direction of the pulp, before supplying the low-pressure steam, the pulp is pressurized so that the pulp pressure at the point of the steam introduction is lower than the pressure of the available steam. After the steam is introduced the pulp is mixed with a pressure-raising mixer (such as a fluidizing centrifugal pump) to divide the steam evenly into the pulp and/or to equalize the temperature of the pulp.

5 Claims, 1 Drawing Sheet

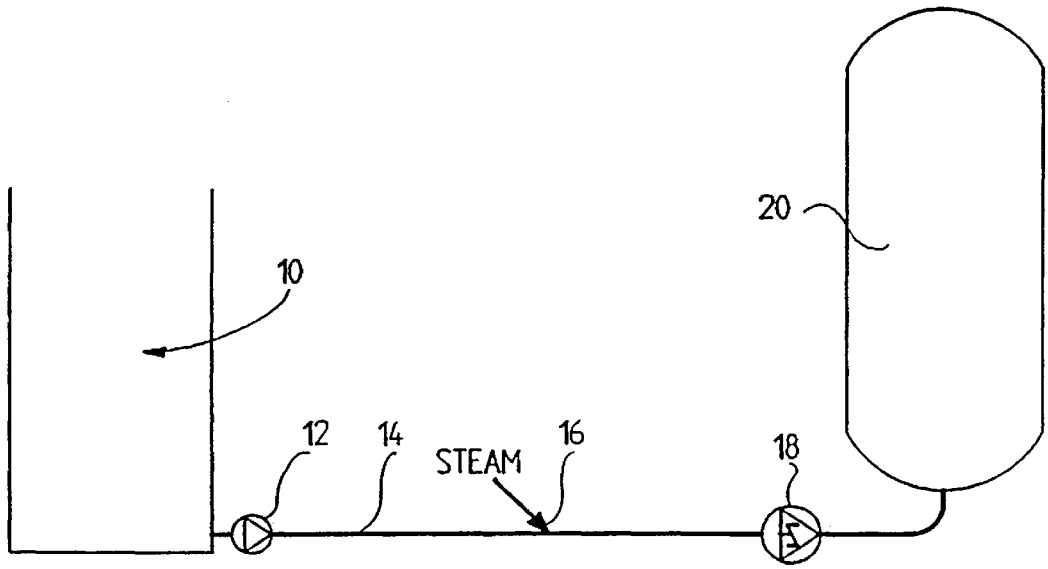
FIG.

METHOD FOR HEATING PULPS

CROSS REFERENCE TO RELATED APPLICATION

This application is a U.S. national phase of International Application No. PCT/F197/00623, filed Oct. 14, 1997.

BACKGROUND AND SUMMARY OF THE INVENTION

The present invention relates to a method and apparatus for heating pulps. In particular, the method and apparatus in accordance with the invention are applicable to heating medium-consistency fiber suspensions of the wood processing industry with low-pressure steam.

In wood processing industry, it is frequently necessary to heat or cool consistent pulp suspensions at a consistency range of 6–20%. Not until in the middle of the 1980's was it possible to do this economically with either direct heating or by means of an indirect heat exchanger. To begin with, some examples are now used to illustrate how pulp is heated or cooled by means of the present-day technology in the mill scale.

In connection with bleaching stages, for example, it is often necessary to raise the temperature of the pulp by 10–20° C., occasionally even by 30° C., in order to achieve the right reaction temperature. The heat is usually raised in such a way that steam is mixed into the pulp prior to the pumping. The mixing is effected either by a peg mixer, which is a large-sized, heavy and expensive device consuming a great deal of energy, or by steam injectors for example into a drop leg for the pulp upstream of a pulp pump. This technique has certain disadvantages, one of them being the noise resulting from this kind of direct heating. Another disadvantage is that because of the large volume of steam, it is not possible to mix very large amounts of steam into the pulp. Yet a third disadvantage is that the pulp becomes heated unevenly, because the heating is, in practice, always performed in open unpressurized apparatus, in which the condensation of the steam is unreliable and uneven. When using unpressurized mixing techniques, the heating may be performed by low-pressure steam, which, although being a very economical source of heat, results in the use of large-sized apparatus. Furthermore, it is self-evident that when using low-pressure steam the upper limit of the temperature will be about 90–95° C. under unpressurized conditions. Thus, due to above-described disadvantages, the temperature can only be raised to a certain extent, in practice approximately by 10–15° C. at the maximum. Of course, it is possible to raise the temperature even by 20° C., but in that case, the apparatus used will be, virtually speaking, unreasonably large. To avoid above-described disadvantages and to make the heating of pulps more efficient, the development of an indirect heating method was set about at the latter half of the 1980's.

Indirect heat exchangers of this type, i.e. so called MC heat exchangers are described in for example EP patent 275502, FI patent applications 781789, 943001, 945783, 953064, 954185 and 955007 and international patent application PCT/FI96/00330. These numerous applications are based on the fact that consistent pulp forms a strong fiber network at a consistency range of 6–20% whereby dividing or combining pulp in flow channels is not possible without special measures. As the consistent pulp reaches a breaching point, the fiber network may be so strong that the pulp flow will not be able to divide by itself. Possibly, the fiber network will stick to uneven points in the flow channel, which results in discharging of water and clogging. Also, combining two flows is difficult. The internal forces of the fiber network are so powerful that two smaller flows will not be able to form a larger, uniform flow without special measures. Required measures being taken, the technical realization of the apparatus becomes possible and the low-pressure steam is used as the source of heat. On the other hand, the apparatus is, at least for the time being, relatively expensive and difficult to manufacture, and therefore an indirect heat exchanger in heating consistent pulps can be applied to only a few, selected objects of use. Thus, the development of an indirect heat exchanger is still at such a phase that there are also grounds to reflect upon the use of direct low-pressure steam in heating pulp.

Thus, it would nevertheless be preferable to use low-pressure steam for direct heating of pulp. In cellulose pulp mills, low pressure steam is classified as waste, the removal of which, i.e. the condensation, has to be arranged in one way or another. If the amount of heat in the low-pressure steam could be utilized in mill processes, it would be possible to sell a larger part of the energy produced at the mill.

However, above-described prior art heating methods based on the use of low pressure steam have turned out to be unreliable. According to our observations, one reason is that when supplying the steam into an atmospheric drop leg from the bottom of which the pulp is removed by pumping, the steam tends to rise in the direction of the lower pressure, i.e. upward, in other words away from the pump. Hence, part of the steam discharges from the pulp, whereby it is virtually necessary to restrict the supply of steam into pulp to such an amount that the condensation of the steam into the pulp is ensured. Using this method, the temperature cannot be raised more than approximately 10 degrees at most. Naturally, one solution, which is even used to some extent within the industry, would be to supply the steam at a high pressure from the drop leg into the pulp to be removed to the pressurized side of the discharge pump, whereby the steam would not have a possibility to discharge anywhere else from the pulp but the only option would be the heating of the pulp by as many degrees as would be required by the amount of the heat in the steam. However, high pressure steam is expensive to use, and therefore it would be highly preferable to avoid the use thereof. SE patent 412610, FI patent application 951196 and SE patent application 9501094 disclose an apparatus enabling the use of low-pressure steam in direct heating of pulp in such a way that the pulp to be heated is made flow in the pipe system from one process stage to another by a pump raising the pressure of the pulp by only a few bar, leaving, however, the pressure of the pipe system lower than the pressure of the steam used for the heating. The steam is mixed into such flowing pulp by means of a special mixer, which is either a rotating mixer described in for example SE patent 419 603, or by means of a basically static mixer described in WO patent application 95/21016. Thereafter, the pulp flows to a second pump, by means of which the pressure of the pulp is raised to a sufficient value for the following process stage, in which the pulp is introduced into an atmospheric or pressurized reaction vessel. In the methods according to the above-described publications, it is, however, considered necessary to mix the steam by means of a special fluidizing or at least efficiently mixing apparatus. A more conventional mixer disclosed in SE-B-419 603 mentioned by said SE application 9501094 is a fluidizing mixer originally intended for mixing oxygen, chlorine and chlorine dioxide into the fluidized pulp in the apparatus. The capacity required by such an MC mixer is also very high. Moreover, the rotor of a fluidizing MC mixer rotates axially relative to the flow, whereby a vortex is formed (induced) on the inlet side of the mixer. In practice, this means that the pulp suspension has a component $v_0$ parallel to the tangent of the rotor already when arriving in the mixing area. Thus, as the rotor rotates at a velocity $v_1$, the pulp only has to speed up by the amount $v_1-v_0$. The intensity of the turbulence, i.e. the mixing efficiency, would be higher if $v_0$ was zero, which is what is aimed at in the inlet conduit of the mixing chamber in accordance with our invention. Another, much more recent publication WO 95/21016 describes a basically static mixer, in which the pulp flowing in the flow pipe is forced to flow through a very narrow slot, whereby the velocity of the pulp naturally increases in relation to the flowing surfaces. In other words, the flow velocity of the pulp in the slot is in practice multiple compared with the flow in the pipe, even so great that the pulp may be considered to be fluidized in the slot, into which the chemical or steam to be mixed is introduced. In other words, both of said apparatus alternatives are characterized by the fact that the pulp is subjected to a mechanical effect in a separate mixer in order to change the state thereof, so that the steam can be mixed evenly into the pulp.

The disadvantages of such direct steam heating apparatus are that, firstly, three separate means are required, i.e. a pump, a mixer, and a second pump; secondly, the mechanical properties of the pulp change in each treatment, whereby the pulp strength deteriorates to some extent; and thirdly, a certain pressure loss always takes place in prior art mixers.

Now we have observed that as regards the overall economy of a mill, the most preferable way to heat pulp would be to effect the heating by direct low-pressure steam in an apparatus comprising at least one pump, one steam mixing means raising the pressure and one feeding means for low-pressure steam between them. In other words, when allowing the pulp to flow through a steam feeding means as an even plug flow, the pulp is not subjected to any kind of stress. The feeding means is positioned into the suction pipe of a mixing means raising the pressure at a desired distance from the mixing means.

The characterizing features of the present method and apparatus become apparent from the appended claims.

BRIEF DESCRIPTION OF THE DRAWINGS

In the following, the method and apparatus according to the invention are explained in more detail with reference to the appended FIGURE, which schematically illustrates a preferred embodiment of the invention.

DETAILED DESCRIPTION OF THE DRAWINGS

In accordance with the FIGURE, an apparatus according to a preferred embodiment comprises a pulp transfer means 12, a steam feeding means 16 and a steam mixing means 18 arranged in the transfer line 14 of the pulp. Said pulp transfer means 12 is a means capable of transferring the pulp in question. In other words, the pulp being at a medium-consistency, as it most often is in modern cellulose mills, it is preferable to use a so called fluidizing centrifugal pump, also known as the MC® pump. Of course, there are also other pumps capable of transferring consistent pulp, for example displacement pumps, which may be used in connection with this process as well. The pulp may come to the transfer means 12 for example from a drop leg 10 of a washer, from a storage tank, or from other location characteristic of the process in question. As the feeding means, there is a product sold by Ahlström Pumput Oy. As the steam mixing means 18, there is a means which raises the pressure, so that the pulp is supplied by means of a mixing means 18, also called a pulp feeding means, into a treatment tower 20 or a corresponding object, for the process of which the pulp needs to be heated.

The above-described apparatus functions in such a way that by means of the transfer means 12, even if it is a fluidizing MC pump, the pulp is transferred as a plug flow via the transfer line 14 to the steam feeding means 16 in such a way that the pressure in the transfer line 14 at the steam feeding means is below the pressure of the available steam. As noted above, it is preferably low-pressure steam that is used, the pressure of which is usually 3–5 bar (abs.) Naturally, situations where the pressure of the low-pressure steam is different from the given 3–5 bar are included within the scope of the invention. In other words, the pulp pressure in the transfer line 14 being lower than the steam pressure, just the amount of steam that is required by the raising of the temperature may be fed into the pulp flowing as a plug flow. In a case like this, the behaviour of the steam in the transfer line is opposite to what it is when steam is mixed in a drop leg in a manner according to prior art. In the drop leg, the steam tends to rise upward, i.e. away from the mixing means. In other words, it is characteristic of the steam, as of gaseous material in general, that it tends to head in the direction of lower pressure. This is also the case with the apparatus according to our invention, in which the steam heads away from the transfer means 12 toward the steam mixing means, i.e. the pulp feeding means 18, by means of which the temperature is equalled and the pulp is transferred to the following treatment means, naturally raising the pressure of the pulp at the same time.

It is characteristic of a preferred embodiment of the invention that the steam feeding means 16 comprises one or more (1–20, preferably 2 –10) steam feeding nozzles or the like, from which the steam is supplied into the pulp flowing as a plug flow. Such nozzles or the like are positioned at a distance of 0–10 meters from the steam mixing means, i.e., the pulp feeding means 18. At least one of the nozzles or the like is positioned at a distance of 0.5–10 meters from the steam mixing means, i.e., the pulp feeding means 18, so that the steam has time to condensate at least in part prior to the passing of the pulp into the means 18. In other words, it is possible to introduce a part of the steam directly into the mixer and another part to some suitable point upstream of the mixer. The above-mentioned distances are, however, to be taken as general guide lines, since ultimately it is the available tube system pressure that determines the dimensioning. By means of the above-described method it is possible to avoid a potential negative effect of a gaseous fraction (steam) on the operation of the feeding means. Another way to prevent the negative effect of the presence of steam on the operation of the feeding means is to design the feeding means in such a way that it is able to treat steam-containing pulp without disturbance.

Said temperature-raising mixing means or pulp feeding means 18 is in the case of medium-consistency pulp preferably a fluidizing centrifugal pump, i.e. a centrifugal pump capable of pumping medium-consistency pulp, comprising a pump housing encircling the pump impeller attached to the shaft, on which impeller a rotor is arranged, which fluidizes pulp, extending to a suction channel being a part of the pump housing or being separately attached thereto. In addition, some changes may be made to the fluidizing centrifugal pump to ensure sufficient condensation of steam before the pulp gets to the pumping area. These kinds of changes to be made to a conventional fluidizing pump include for example ribs, pins, nubs or corresponding members arranged on the wall of the suction channel, by means of which members the turbulence level in the pulp is raised. Furthermore, according to a preferable embodiment of the invention, the pressure-raising means is a centrifugal pump to which a mixing chamber is connected. This mixing chamber is preferably, but not necessarily, larger than the smallest diameter of the suction channel. In the mixing chamber, there is a mixing member, which may be either a rotor operated by a drive of its own, or, in the case of a fluidizing centrifugal pump, a fluidizer thereof. If required, ribs, pins or other members raising the turbulence level are arranged on the front and/or back side of the mixing means and/or at the mixing means on the wall of the suction channel or mixing chamber.

According to a preferred embodiment of the invention, the mixture of pulp and steam is introduced either into said fluidizing centrifugal pump, more precisely into the suction channel thereof, or into said mixing chamber in such a way that prior to passing into the pump, said mixture has to pass through the circle of rotation of said rotor, whereby the steam is efficiently condensed into the pulp. One way to achieve such an action is to arrange the supply of the mixture of pulp and steam from a non-axial direction, preferably radially, into the mixing chamber or into the suction channel of the fluidizing centrifugal pump, which suction channel functions as the mixing chamber. Hereby, the rotor rotating in the mixing chamber or a fluidizing rotor rotating in the suction channel of a fluidizing centrifugal pump receive the whole of the pulp and steam arriving in the mixing space, mixing them evenly with each other. At the same time, some retention time can be ensured for the mixing itself, so that the steam has sufficiently time to condensate into the pulp. Another, though structurally somewhat more complex, method is to supply said mixture axially but to direct thereafter the flow of the mixture in the chamber in such a way that the above-described action takes place. If considered necessary, also other kinds of modifications may be made.

Preferable objects of use of the invention include processes already in use but in need of modernization. In processes in which for example the capacity of the pumps is intended for a given tube system resistance, it is not possible to arrange either direct or indirect heating of pulp, because these would increase the tube system resistance in any case, which would result in the pump already in the process not being able to transfer pulp through a heating means to the following process stage. If there was a wish to modernize such an apparatus according to present-day technology, a new, efficient pump and feeding means for high-pressure steam would have to be acquired. In other words, it would be necessary to use high-pressure steam to heat the pulp. This problem is solved by our invention in such a way that the old pump stays where it is and a feeding means for low-pressure steam and a temperature-raising steam mixer are added.

It is to be understood that only a few preferred embodiments of the invention are dealt with above, and it is by no means the intention to restrict the scope of the invention, which is defined by the appended claims only.

What is claimed is:

1. A method of heating cellulose pulp comprising:

(a) pressurizing the pulp to a first pressure so that the pressure of the pulp is lower than the pressure of available steam;

(b) causing the pressurized pulp to flow in a flow direction as a plug flow;

(c) introducing low pressure steam, through one or more nozzles, into the pulp as it is flowing in the flow direction as said plug flow and at a location where the pressure of the pulp is lower than the pressure of the low pressure steam introduced to the pulp;

(d) after (c) directing the plug flow of pulp in which said low pressure steam has been introduced to a pressure-raising mixer, and subsequently utilizing the mixer to simultaneously mix steam into the pulp, and raise the pressure of the pulp to a level higher than the pressure of the pulp in (a) wherein at least part of the steam has time to condense between being introduced into the pulp and the pressure-raising mixer; and thereafter (e) supplying the pulp from (d) to following process stages utilizing the pressure of the pulp after (d) to provide the motive force.

2. A method as recited in claim 1 wherein (c) is practiced by adding steam at a pressure between 3–5 bar absolute.

3. A method as recited in claim 2 wherein (d) is practiced by subjecting the pulp to the action of a fluidizing centrifugal pump so as to substantially evenly distribute the steam in the pulp and equalize the temperature of the pulp.

4. A method as recited in claim 1 wherein (b) is practiced by utilizing a centrifugal pump.

5. A method as recited in claim 1 wherein (d) is practiced utilizing a fluidizing centrifugal pump as the pressure-raising steam mixer.

* * * * *